US011371504B2

(12) United States Patent
Ma et al.

(10) Patent No.: US 11,371,504 B2
(45) Date of Patent: Jun. 28, 2022

(54) SCROLL COMPRESSOR

(71) Applicant: Danfoss (Tianjin) Ltd., Tianjin (CN)

(72) Inventors: Lin Ma, Tianjin (CN); Wenhu Yao, Tianjin (CN); Kun Qian, Tianjin (CN); Bin Wang, Tianjin (CN); Guillaume Rochet, Tianjin (CN)

(73) Assignee: Danfoss (Tianjin) Ltd., Tianjin (CN)

( * ) Notice: Subject to any disclaimer, the term of this patent is extended or adjusted under 35 U.S.C. 154(b) by 42 days.

(21) Appl. No.: 17/032,738

(22) Filed: Sep. 25, 2020

(65) Prior Publication Data

US 2021/0095666 A1 Apr. 1, 2021

(30) Foreign Application Priority Data

Sep. 29, 2019 (CN) ..... 201921647030.6

(51) Int. Cl.

| | |
|---|---|
| ***F04C 18/02*** | (2006.01) |
| ***F04C 29/00*** | (2006.01) |
| ***F04C 29/04*** | (2006.01) |

(52) U.S. Cl.

CPC ..... *F04C 18/0215* (2013.01); *F04C 29/0007* (2013.01); *F04C 29/042* (2013.01); *F04C 2230/231* (2013.01)

(58) Field of Classification Search

CPC .... F04C 18/0207–0292; F04C 29/0007; F04C 29/0014; F04C 29/042; F04C 2230/231

See application file for complete search history.

(56) References Cited

U.S. PATENT DOCUMENTS 5,640,854 A * 6/1997 Fogt ..... F01C 1/0215 62/197
2008/0184733 A1* 8/2008 Skinner ..... F04C 23/008 62/505

(Continued)

FOREIGN PATENT DOCUMENTS

CN 201953655 U 8/2011
CN 202926628 U 5/2013

(Continued)

OTHER PUBLICATIONS

First Examination Report for Indian Patent Application No. 202014041022 dated Jun. 29, 2021.

*Primary Examiner* — Mark A Laurenzi
*Assistant Examiner* — Xiaoting Hu
(74) *Attorney, Agent, or Firm* — McCormick, Paulding & Huber PLLC

(57) ABSTRACT

A scroll compressor is disclosed. The scroll compressor includes an shell, a fixed scroll, a housing and an orbiting scroll. The fixed scroll and the housing are disposed in the shell and fixed relative to each other. An outer peripheral surface of the housing and an inner peripheral surface of the shell are fitted to each other. The orbiting scroll is disposed between the fixed scroll and the housing. The fixed scroll is formed therein with a first injection passage, the housing is formed therein with a second injection passage, a port of the first injection passage and a port of the second injection passage face each other, so that the first injection passage and the second injection passage communicate with each other. The scroll compressor further includes an injection tube assembly, the injection tube assembly is disposed in the shell. The injection tube assembly includes: a tube, and a first tube joint and a second tube joint respectively disposed at two ends of the tube, the first tube joint passes through the (Continued)

shell to communicate with the outside, and the second tube joint is inserted and fitted in the second injection passage.

20 Claims, 5 Drawing Sheets

(56) References Cited

U.S. PATENT DOCUMENTS

| | | | | |
|---|---|---|---|---|
| 2010/0008807 | A1* | 1/2010 | Roof | F04C 23/008 418/55.1 |
| 2010/0098570 | A1* | 4/2010 | Bodart | F04C 29/021 418/55.1 |
| 2019/0277288 | A1 | 9/2019 | Flanigan et al. | |
| 2019/0316589 | A1* | 10/2019 | Endou | F04C 18/0215 |

FOREIGN PATENT DOCUMENTS

| | | | | |
|---|---|---|---|---|
| CN | 102052312 | B | * | 8/2013 |
| CN | 105545733 | A | | 5/2016 |
| CN | 106401953 | A | * | 2/2017 |
| CN | 106401953 | A | | 2/2017 |
| CN | 207297351 | U | * | 5/2018 |
| EP | 0479421 | A1 | | 4/1992 |
| JP | 5152359 | B2 | | 2/2013 |
| KR | 100547376 | B1 | | 1/2006 |

* cited by examiner

SCROLL COMPRESSOR

CROSS-REFERENCE TO RELATED APPLICATION

This application claims foreign priority benefits under 35 U.S.C. § 119 to Chinese Patent Application No. 201921647030.6 filed on Sep. 29, 2019, the content of which is hereby incorporated by reference in its entirety.

BACKGROUND OF THE INVENTION

Technical Field

The present invention relates to a scroll compressor, and in particular, to a scroll compressor provided with an injection tube assembly.

Background

FIG. 1 shows an existing scroll compressor. As shown in the area A indicated by the dotted box in FIG. 1, a refrigerant injection tube assembly 4 is provided in the scroll compressor to improve the performance of the scroll compressor. Because a length of a refrigerant flow tube 403 of the refrigerant injection tube assembly 4 is relatively short, it is difficult for workers to access the refrigerant flow tube 403 and accurately align the refrigerant flow tube 403 with a tube joint 401 assembled on the casing 1 when the scroll compressor is assembled upside down. Therefore, the refrigerant injection tube assembly 4 shown in FIG. 1 is not suitable for the case where the scroll compressor is assembled upside down.

For this reason, a solution to lengthen the injection tube assembly 4 has been proposed in the prior art to be suitable for assembling the scroll compressor upside down. However, due to the installation method of the injection tube, it is easy to form gaps in components, such as the housing of the compressor, through which the injection tube passes, causing refrigerant to leak through the gaps, thereby causing problems such as overheating or even burning of the electric motor of the compressor.

SUMMARY

Technical Problem

The present invention has been made in order to solve the above technical problems and other potential technical problems.

Technical Solution

In accordance with an aspect of the present invention, there is provided a scroll compressor. The scroll compressor includes an shell, a fixed scroll, a housing and an orbiting scroll. The fixed scroll and the housing are disposed in the shell and fixed relative to each other. An outer peripheral surface of the housing and an inner peripheral surface of the shell are fitted to each other. The orbiting scroll is disposed between the fixed scroll and the housing. The fixed scroll is formed therein with a first injection passage, the housing is formed therein with a second injection passage, a port of the first injection passage and a port of the second injection passage face each other, so that the first injection passage and the second injection passage communicate with each other. The scroll compressor further includes an injection tube assembly, the injection tube assembly is disposed in the shell. The injection tube assembly includes: a tube, and a first tube joint and a second tube joint respectively disposed at two ends of the tube, the first tube joint passes through the shell to communicate with the outside, and the second tube joint is inserted and fitted in the second injection passage.

The second injection passage is a through hole running through the housing.

The second tube joint is inserted in only a portion of the through hole.

The port of the first injection passage and the port of the second injection passage are hermetically joined together.

The outer peripheral surface of the housing and the inner peripheral surface of the shell are gas-tightly fitted to each other, and the second tube joint and the second injection passage are gas-tightly fitted to each other.

The tube, the first tube joint, and the second tube joint are all made of metal, and the first tube joint and the second tube joint are configured to be welded to two ends of the tube, respectively.

A first end of the second tube joint is connected to the tube, and a second end of the second tube joint is inserted into the second injection passage. A groove is formed on an outer peripheral wall of the second end of the second tube joint, and an O-ring seal is disposed in the groove.

A first end of the first tube joint passes through a through hole formed in the shell, and a second end of the first tube joint is connected to the tube. The second end of the first tube joint includes a flange and a main body. The main body is configured to be fastened to the flange by a screw. A first end face of the flange faces toward the main body, and a second end face of the flange is configured to be welded to the tube.

A gasket is disposed between the first end face of the flange and a fitting surface of the main body.

The scroll compressor further includes an electric motor, the electric motor is disposed in the shell and has a casing, and the tube extends along an axial direction of the fixed scroll between the casing and the shell.

Technical Effects

With the above technical solutions of the present invention, the assembly of the scroll compressor can be facilitated in the process of manufacturing the scroll compressor, and especially, the installation of the injection tube assembly of the compressor is improved. Based on the improvement of the installation method of the injection tube assembly, refrigerant leakage can be effectively prevented, thereby eliminating problems such as the overheating of the electric motor of the compressor caused by refrigerant leakage.

BRIEF DESCRIPTION OF THE DRAWINGS

In order to facilitate understanding of the present invention, the present invention will be described in more detail based on exemplary embodiments in conjunction with the drawings. The same or similar reference numerals are used in the drawings to indicate the same or similar components. It should be understood that the drawings are only schematic, and the dimensions and proportions of components in the drawings are not necessarily accurate.

DETAILED DESCRIPTION

Figure 1:
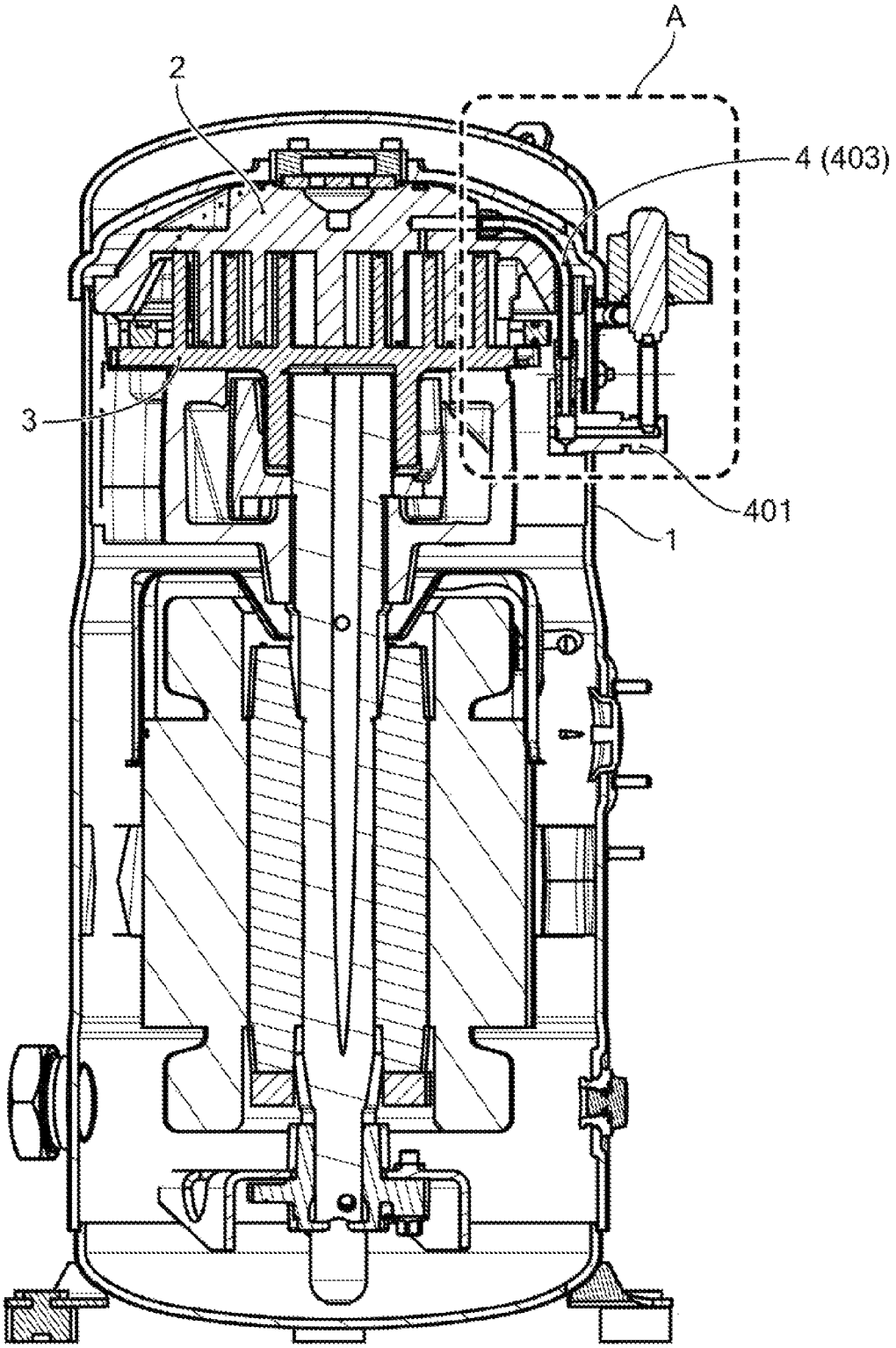
FIG. 1 is a sectional view of an existing scroll compressor.
Figure 2:
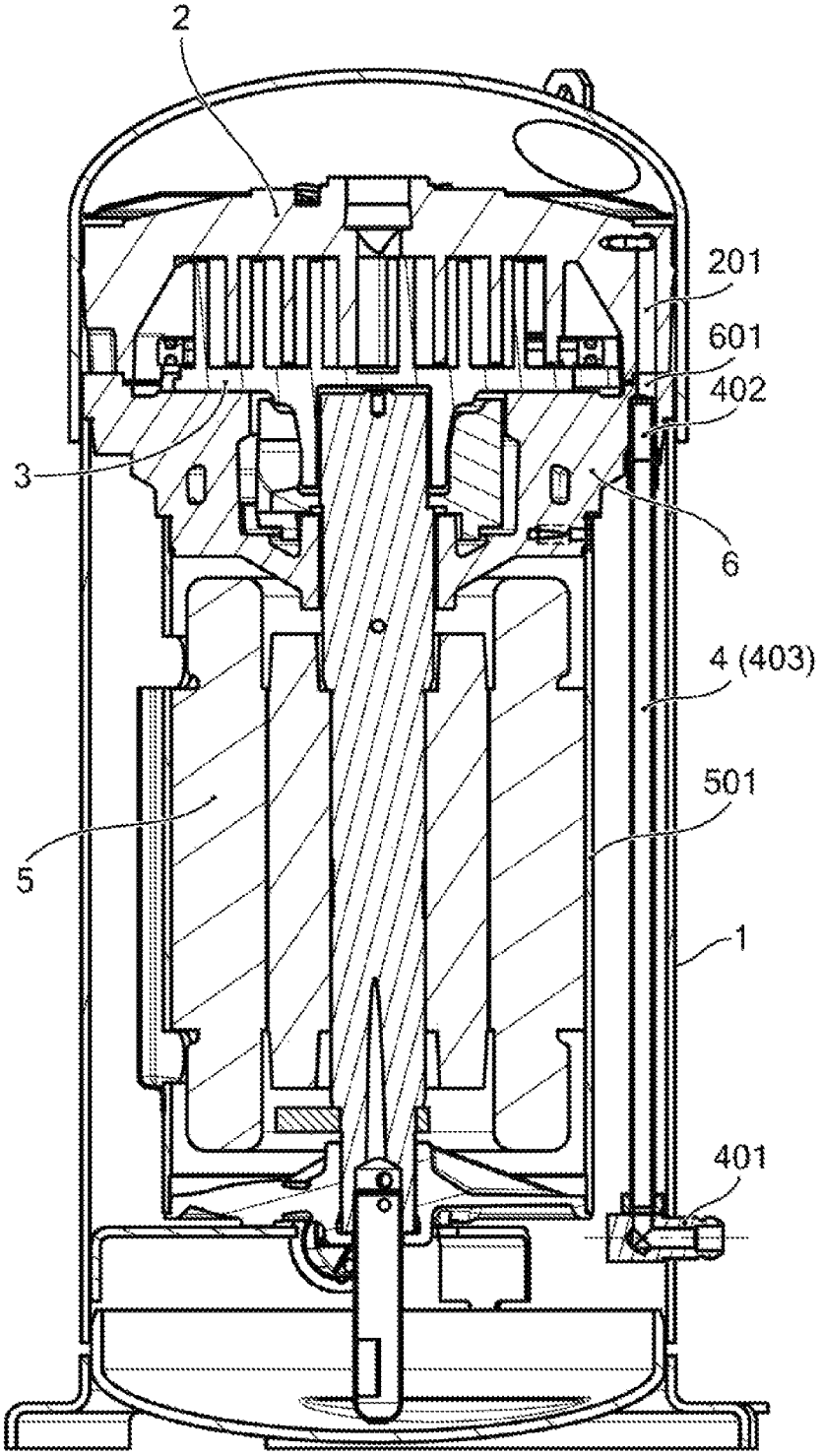
FIG. 2 is a sectional view of a scroll compressor according to an embodiment of the present invention.
Figure 3:
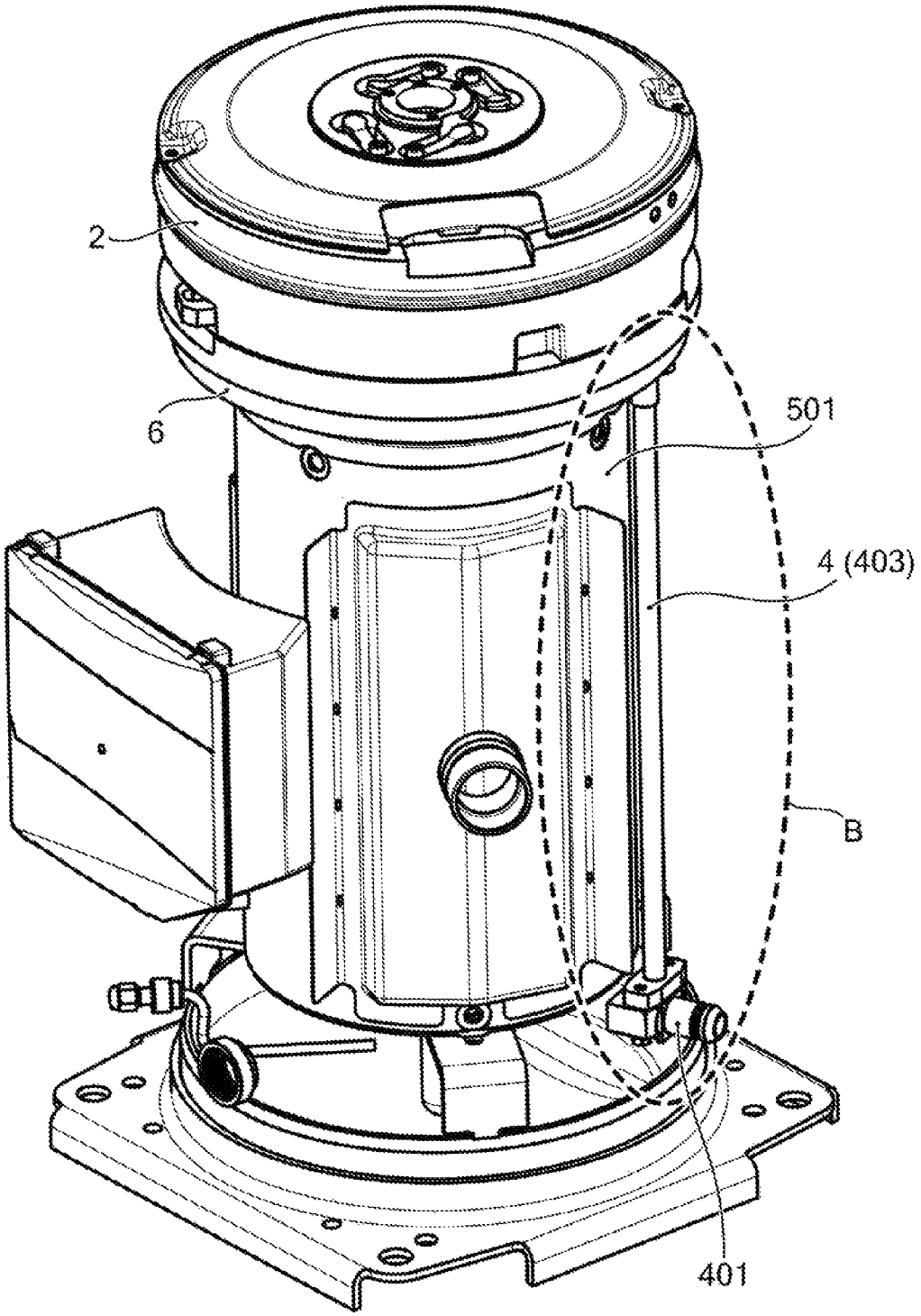
FIG. 3 is a perspective view of the scroll compressor shown in FIG. 2.

FIG. 2 is a sectional view of a scroll compressor according to an embodiment of the present invention. FIG. 3 is a perspective view of the scroll compressor shown in FIG. 2. In FIG. 3, a part of the shell of the scroll compressor is removed in order to show the internal structure more clearly.

A scroll compressor according to an embodiment of the present invention includes a shell 1, and a fixed scroll 2, an orbiting scroll 3, an injection tube assembly 4, an electric motor 5, and a housing 6, which are disposed in the shell 1. The fixed scroll 2 and the housing 6 are disposed in the shell 1 and fixed relative to each other. An outer peripheral surface of the housing 6 and an inner peripheral surface of the shell 1 are fitted to each other. The orbiting scroll 3 is disposed between the fixed scroll 2 and the housing 6 and is indirectly driven by the electric motor 5.

The fixed scroll 2 is formed therein with a first injection passage 201, and the housing 6 is formed therein with a second injection passage 601. A lower port of the first injection passage 201 and an upper port of the second injection passage 601 face each other, so that the first injection passage 201 and the second injection passage 601 communicate with each other.

The injection tube assembly 4 includes: a tube 403, and a first tube joint 401 and a second tube joint 402 respectively disposed at two ends of the tube. The first tube joint 401 passes through the shell 1 to communicate with the outside, and the second tube joint 402 is inserted in the second injection passage 601. In particular, the second tube joint 402 is extended in only a portion of the second injection passage 601, rather than running through the entire second injection passage 601. In other words, the remaining portion of the second injection passage 601 and the entire first injection passage 201 directly form a flow passage for injected liquid.

Figure 4A:
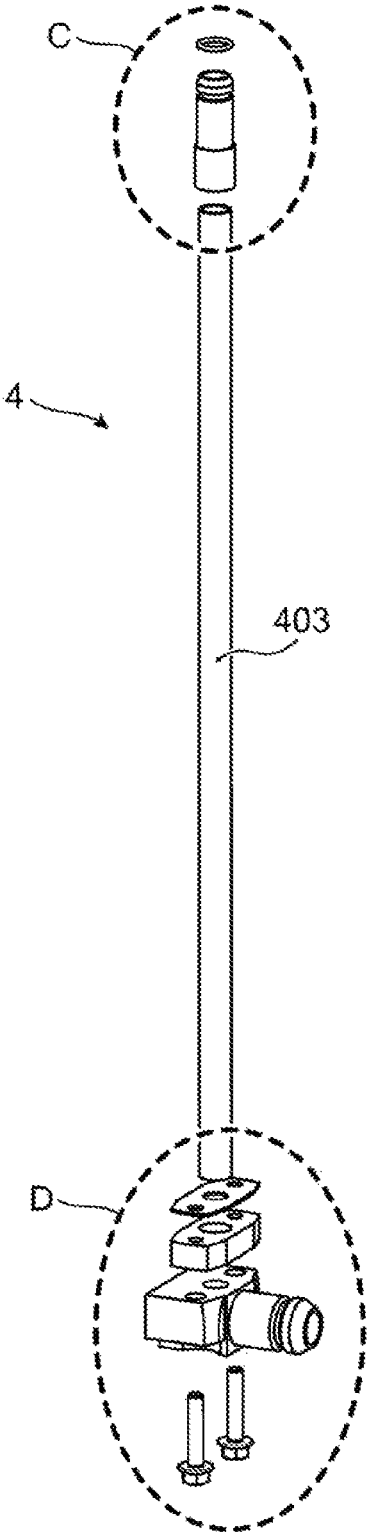
FIG. 4A is an exploded perspective view of an injection tube assembly in an area B in FIG. 3.
Figure 4B:
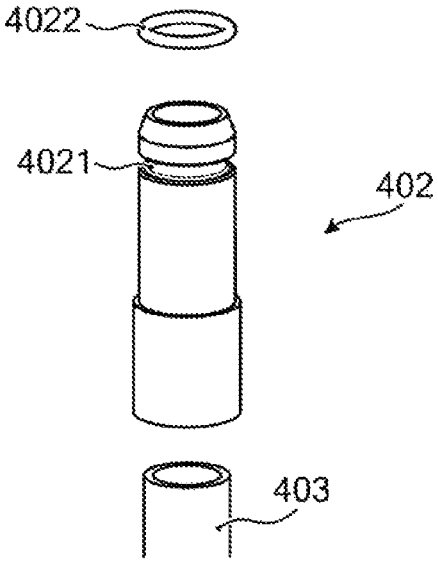
FIGS. 4B and 4C are respectively partial enlarged views of an area C and an area D in FIG. 4A.
Figure 4C:
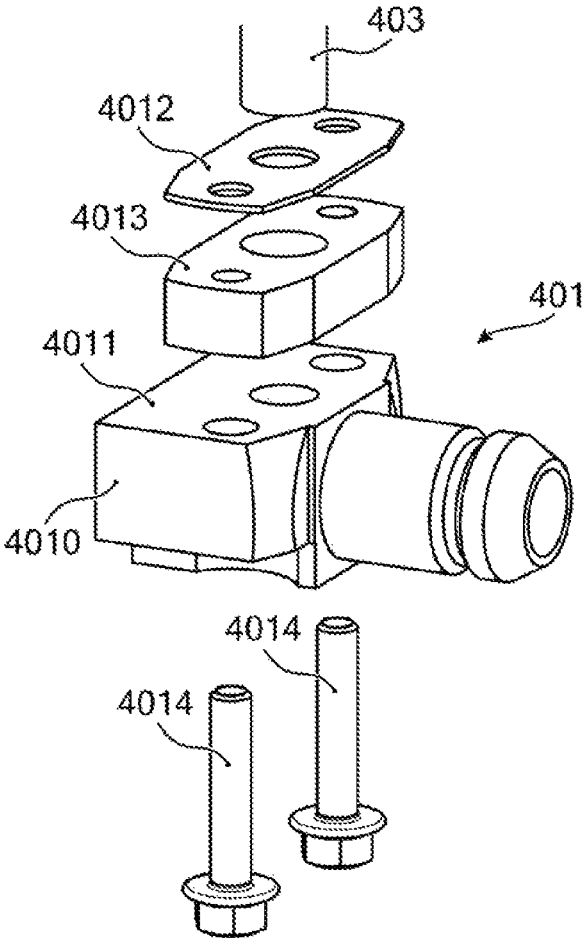

FIG. 4A is an exploded perspective view of an injection tube assembly 4 in an area B in FIG. 3. FIGS. 4B and 4C are respectively partial enlarged views of an area C and an area D in FIG. 4A.

As shown in FIGS. 4A, 4B, and 4C, the tube 403, the first tube joint 401, and the second tube joint 402 may be made of metal (for example, steel or copper). The first tube joint 401 and the second tube joint 402 are respectively welded to a lower end and an upper end of the tube 403. The lower end of the second tube joint 402 is connected to the tube 403. The upper end of the second tube joint 402 is inserted in the second injection passage 601. A groove 4021 is formed on the outer peripheral wall of the upper end of the second tube joint 402, and an O-ring seal 4022 is disposed in the groove 4021, so that the second tube joint 402 is inserted in the second injection passage 601 to be gas-tightly fitted to the second injection passage 601. As a result, gases such as the refrigerant flowing through the tube 403 and the second injection passage 601 will not leak here.

As shown in FIG. 2, the right end of the first tube joint 401 passes through a through hole formed in the shell 1 and is connected to a gas passage provided outside the compressor. The upper end of the first tube joint 401 is connected to the tube 403. As shown in FIG. 4C, the first tube joint 401 includes a flange 4012 and a main body 4010. The main body 4010 is fastened to the flange 4012 by a screw 4014. The lower end face of the flange 4012 faces toward the main body, and the upper end face of the flange 4012 is welded to the tube 403. In this way, a refrigerant passage is formed in the first tube joint 401 and the tube 403.

In addition, a gasket 4013 may also be disposed between the lower end face of the flange 4012 and a fitting surface 4011 of the main body.

Figure 5A:
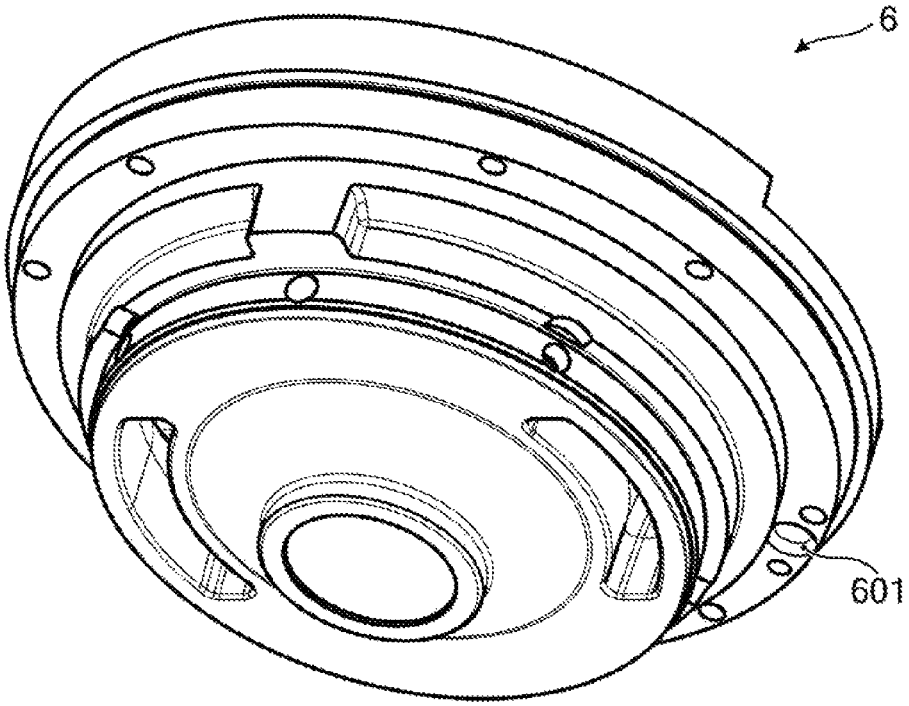
FIGS. 5A and 5B are respectively a perspective view and a sectional perspective view of a housing in the scroll compressor according to an embodiment of the present invention.
Figure 5B:
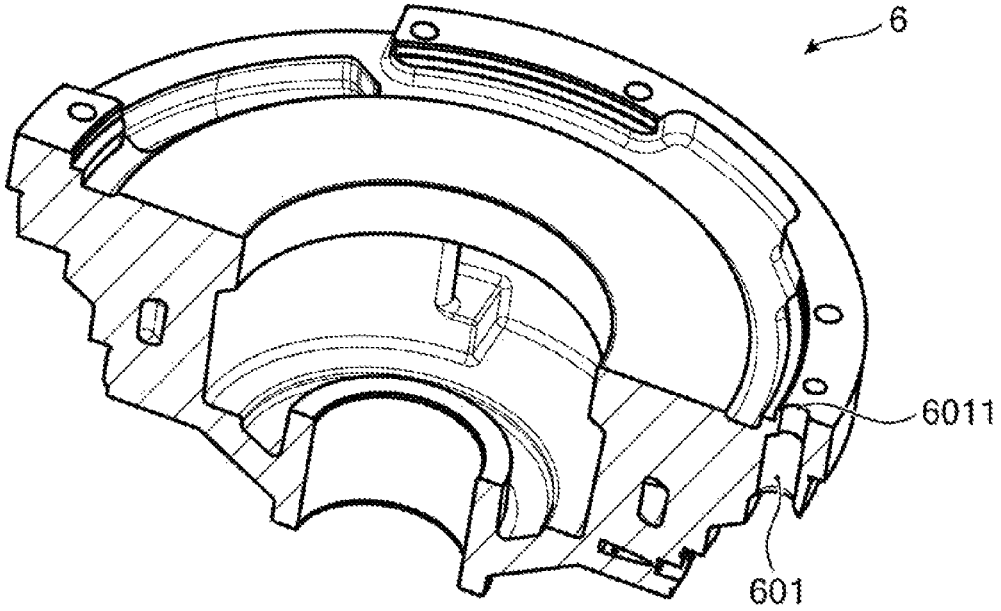

FIGS. 5A and 5B are respectively a perspective view and a sectional perspective view of a housing 6 in the scroll compressor according to an embodiment of the present invention.

As shown in FIGS. 5A and 5B, the second injection passage 601 is a through hole running through the housing 6. The second tube joint 402 is inserted in only a part of the through hole 601 from below the through hole (i.e., the second injection passage) 601. Preferably, the second tube joint 402 is inserted in the through hole 601 and gas-tightly fitted to the through hole 601, so that the refrigerant gas in the compressor does not leak here. The fitting surfaces of the housing 6 and the shell 1 are closely fitted to each other without a gap between them, and the fitting surfaces of the second tube joint 402 and the second injection passage 601 are closely fitted to each other without a gap between them. Thereby, a gap can be prevented from being formed between the outer peripheral surface of the housing 6 and the inner peripheral surface of the shell 1 (that is, the fitting surfaces of them), and a gap can be prevented from being formed between the outer peripheral surface of the tube 403 or the second tube joint 402 and the second injection passage 601, and thus preventing the refrigerant gas from leaking upward through these gaps.

The upper port 6011 of the through hole 601 and the lower port of the first injection passage 201 face each other. Optionally, a sealing groove and/or gasket (not shown in the figures) are/is provided at the junction of the upper port 6011 of the through hole 601 and the lower port of the first injection passage 201, to prevent the refrigerant from leaking at the junction of the injection passage.

Although the technical objects, technical solutions, and technical effects of the present invention have been described in detail above with reference to the specific embodiments, it should be understood that the above embodiments are only exemplary, but are not restrictive. All of the modifications, equivalent substitutions and improvements made by those skilled in the art without departing from the principles and spirit of the present invention should fall within the protection scope of the present invention.

What is claimed is:

1. A scroll compressor, comprising:

a shell;

a fixed scroll;

a housing, wherein the fixed scroll and the housing are disposed in the shell and are fixed relative to each other, and an outer peripheral surface of the housing and an inner peripheral surface of the shell are fitted to each other; and an orbiting scroll disposed between the fixed scroll and the housing, wherein, the fixed scroll is formed therein with a first injection passage, the housing is formed therein with a second injection passage, and a port of the first injection passage and a port of the second injection passage face each other, so that the first injection passage and the second injection passage communicate with each other; and the scroll compressor further comprises an injection tube assembly, the injection tube assembly is disposed in the shell, the injection tube assembly comprises: a tube, and a first tube joint and a second tube joint respectively disposed at two ends of the tube, the first tube joint passes through the shell to communicate with an outside, and the second tube joint is inserted and fitted in the second injection passage.

2. The scroll compressor of claim 1, wherein the second injection passage is a through hole running through the housing.

3. The scroll compressor of claim 2, wherein the second tube joint is inserted in only a portion of the through hole.

4. The scroll compressor of claim 3, wherein the scroll compressor further comprises an electric motor, the electric motor is disposed in the shell and has a casing, and the tube extends along an axial direction of the fixed scroll between the casing and the shell.

5. The scroll compressor of claim 2, wherein the port of the first injection passage and the port of the second injection passage are hermetically joined together.

6. The scroll compressor of claim 5, wherein the scroll compressor further comprises an electric motor, the electric motor is disposed in the shell and has a casing, and the tube extends along an axial direction of the fixed scroll between the casing and the shell.

7. The scroll compressor of claim 2, wherein the scroll compressor further comprises an electric motor, the electric motor is disposed in the shell and has a casing, and the tube extends along an axial direction of the fixed scroll between the casing and the shell.

8. The scroll compressor of claim 1, wherein the outer peripheral surface of the housing and the inner peripheral surface of the shell are gas-tightly fitted to each other, and the second tube joint and the second injection passage are gas-tightly fitted to each other.

9. The scroll compressor of claim 8, wherein a first end of the second tube joint is connected to the tube, and a second end of the second tube joint is inserted in the second injection passage, wherein, a groove is formed on an outer peripheral wall of the second end of the second tube joint, and an O-ring seal is disposed in the groove.

10. The scroll compressor of claim 9, wherein the scroll compressor further comprises an electric motor, the electric motor is disposed in the shell and has a casing, and the tube extends along an axial direction of the fixed scroll between the casing and the shell.

11. The scroll compressor of claim 8, wherein the scroll compressor further comprises an electric motor, the electric motor is disposed in the shell and has a casing, and the tube extends along an axial direction of the fixed scroll between the casing and the shell.

12. The scroll compressor of claim 1, wherein the tube, the first tube joint, and the second tube joint are all made of metal, and the first tube joint and the second tube joint are configured to be welded to two ends of the tube, respectively.

13. The scroll compressor of claim 12, wherein the scroll compressor further comprises an electric motor, the electric motor is disposed in the shell and has a casing, and the tube extends along an axial direction of the fixed scroll between the casing and the shell.

14. The scroll compressor of claim 1, wherein a first end of the first tube joint passes through a through hole formed in the shell, and a second end of the first tube joint is connected to the tube, wherein, the second end of the first tube joint comprises a flange and a main body, and the main body is configured to be fastened to the flange by a screw, a first end face of the flange faces toward the main body, and a second end face of the flange is configured to be welded to the tube.

15. The scroll compressor of claim 14, wherein a gasket is disposed between the first end face of the flange and a fitting surface of the main body.

16. The scroll compressor of claim 15, wherein the scroll compressor further comprises an electric motor, the electric motor is disposed in the shell and has a casing, and the tube extends along an axial direction of the fixed scroll between the casing and the shell.

17. The scroll compressor of claim 14, wherein the scroll compressor further comprises an electric motor, the electric motor is disposed in the shell and has a casing, and the tube extends along an axial direction of the fixed scroll between the casing and the shell.

18. The scroll compressor of claim 1, wherein the scroll compressor further comprises an electric motor, the electric motor is disposed in the shell and has a casing, and the tube extends along an axial direction of the fixed scroll between the casing and the shell.

19. The scroll compressor of claim 1, wherein the port of the first injection passage and the port of the second injection passage are hermetically joined together.

20. The scroll compressor of claim 1, wherein the second tube joint is gas-tightly fitted in the second injection passage.

* * * * *